US007270627B2

(12) United States Patent
Hankin

(10) Patent No.: US 7,270,627 B2
(45) Date of Patent: Sep. 18, 2007

(54) EXERCISER

(76) Inventor: Philip Raymond Hankin, 79 Derwent Drive, Priorslee, Telford Tf2 9QR (GB)

( * ) Notice: Subject to any disclaimer, the term of this patent is extended or adjusted under 35 U.S.C. 154(b) by 0 days.

(21) Appl. No.: 10/541,942

(22) PCT Filed: Jan. 6, 2004

(86) PCT No.: PCT/GB2004/000019

§ 371 (c)(1),
(2), (4) Date: Aug. 1, 2005

(87) PCT Pub. No.: WO2004/062550

PCT Pub. Date: Jul. 29, 2004

(65) Prior Publication Data

US 2006/0116246 A1 Jun. 1, 2006

(30) Foreign Application Priority Data

Jan. 9, 2003 (GB) ..... 03004512

(51) Int. Cl.
*A63B 23/10* (2006.01)
*A63B 22/00* (2006.01)
*A63B 21/00* (2006.01)
*A61H 1/02* (2006.01)

(52) U.S. Cl. ..... 482/79; 482/51; 482/92; 601/27

(58) Field of Classification Search ..... 482/79, 482/80, 131, 132, 140, 907; 601/27–32, 601/35, 104; 446/46, 47; 441/70
See application file for complete search history.

(56) References Cited

U.S. PATENT DOCUMENTS 1,497,243 A * 6/1924 Martin ..... 606/237
3,024,021 A * 3/1962 Coplin et al. ..... 482/146
3,356,367 A * 12/1967 Tewksbury ..... 482/77
3,874,100 A * 4/1975 Schwitters ..... 36/11.5
4,157,631 A * 6/1979 Kifferstein et al. ..... 446/46
4,176,843 A * 12/1979 DeWitt, Jr. ..... 446/46
4,253,661 A * 3/1981 Russell ..... 482/79
4,356,660 A * 11/1982 O'Brien ..... 446/256
4,603,851 A * 8/1986 Russell ..... 482/79
4,864,740 A * 9/1989 Oakley ..... 36/44
4,892,305 A * 1/1990 Lynch ..... 482/132
4,940,441 A * 7/1990 Novinsky ..... 446/46
5,320,361 A * 6/1994 Hellerman ..... 473/588
5,366,403 A * 11/1994 Weiss ..... 446/46
5,480,334 A * 1/1996 Wilson et al. ..... 446/46
5,643,164 A * 7/1997 Teff ..... 482/146
D387,817 S * 12/1997 Noyes ..... D21/443
5,891,002 A * 4/1999 Maki ..... 482/79
6,185,844 B1 * 2/2001 Janzen ..... 36/3 B
6,582,347 B2 * 6/2003 Smith ..... 482/140
6,780,142 B1 * 8/2004 Takizawa et al. ..... 482/8
2003/0013373 A1 * 1/2003 Bloeme et al. ..... 446/46

* cited by examiner

*Primary Examiner*—Stephen R. Crow
*Assistant Examiner*—Allana Lewin
(74) *Attorney, Agent, or Firm*—Smith-Hill and Bedell

(57) ABSTRACT

In order to provide rehabilitation, physiotherapy and maintain suppleness, an exerciser is provided in which a skid with a slide or movement surface is provided on one side and a grip on the other in order that a user can perform controlled oscillatory motions by resting a limb upon the grip. In such circumstances, for example, bed ridden patients recovering from hip or other joint replacement surgery can initially conveniently perform oscillatory motions, the extent of which can be progressively controlled to improve mobility. The exerciser can also be used for recuperative muscle development and maintenance of suppleness with regard to limb and joint movements.

19 Claims, 5 Drawing Sheets

EXERCISER

This is a national stage application filed under 35 USC 371 based on International Application No. PCT/GB2004/000019 filed Jan. 6, 2004, and claims priority under 35 USC 119 of United Kingdom Patent Application No. 0300451.2 filed Jan. 9, 2003.

The present invention relates to exercisers and more particularly, but not exclusively, to exercisers used for physiotherapy and circulatory exercise by bedridden and after-care patients.

After certain orthopaedic surgery, it is necessary to progressively rebuild confidence, strength and mobility in the affected body part. For example, with knee surgery it is necessary to stimulate progressive bending of a patient's knee without over straining that knee. It will also be understood that such exercise will generally occur at least initially whilst the patient is still bedridden.

Previously, a so-called "rehab" board has been used for the above exercise. This "rehab" board essentially comprises a flat wooden board or panel placed upon the patient's bed and a doughnut or ring bandage is then formed within which a patient's heel is placed in order that the leg can be bent by sliding the doughnut to and fro along the board to gradually increase flexibility and strength. Clearly, carrying a hefty wooden board and forming a ring or doughnut bandage for each patient is cumbersome and time consuming.

In addition to exercises with respect to knee and hip replacement, it will also be understood that various patients with respect to recovery from other limb surgery, strokes, forms of orthopaedic surgery and fractures also require at least initially gentle exercise in order to initiate a recovery process. Furthermore, in post operative rehabilitation, the exercisers will also have applications for general exercise routines, i.e. utilising tension bands around the foot or limb whilst stretching to increase muscle growth, etc. There is also a requirement for a readily transportable exerciser for general exercise during spare or leisure time.

In accordance with the present invention there is provided an exerciser for physiotherapy or general exercise, the exerciser comprising a skid with a slide surface upon one side and a grip upon the other side whereby a user can perform oscillatory motions by resting a limb upon the grip.

Preferably, the slide surface is flat. Alternatively, the slide surface is curved. Furthermore, the slide surface may be curved in a side to side or front to back or both directions.

Typically, the skid is a unitary moulding. Alternatively, the skid may be stamped or machined to provide an appropriate shape.

Generally, that moulding is formed from a plastics or metal material. Normally, the skid would be rendered suitable for heat sterilisation.

The skid may include an insert to provide the grip. Possibly, the insert is disposable. Advantageously, the insert can be specifically shaped for a user's requirements in terms of the limb used or exercise required. A number of different insert shapes may be secured to or moulded into the skid in order to provide the present exerciser. Alternatively, the skid may be a dimpled or cross-hatched or have a ribbed surface to provide the grip.

The skid may have a generally round, oblong, polygon or rectangular shape.

The grip may be provided by a non-slip elastomeric material. Typically, that elastomeric material may be a polyvinyl chloride PVC material.

Preferably, the skid has an upturned curved rim away from the slide surface to prevent snagging of the exerciser during use.

Advantageously, the upturned rim provides a dished configuration for the skid which cooperates with the grip in use.

Possibly, the skid incorporates a cushioning material between the grip and the slide surface.

Possibly, the slide surface includes guide ribs or keels to facilitate a preferred direction of slide for the exerciser.

Possibly, the grip is shaped to reciprocally engage a limb contour. Typically, the grip is shaped to include an open aspect to receive an Achilles tendon of an ankle or elbow joint of an arm.

Possibly, the slide side comprises spaced rails or fins incorporating detent apertures to accommodate roller means. Typically, the roller means will incorporate bearings to enter the detent apertures to allow rotation of the roller means and therefore effective slide of the exerciser, particularly upon hard floors.

Possibly, the roller means include roller surfaces having a higher friction coefficient to facilitate rolling of the slide surface. Typically, the detent apertures will be bulbous to allow snap fitting of the roller means within the rails or fins. Generally the roller means will only extend marginally below the rails or fins such that those rails or fins provide stability and guidance for the exerciser.

Possibly the rollers incorporate inertia brakes to limit slide distance or arc or rate of slide. Possibly, such brakes incorporate means to limit the number of rotations of the roller or the speed of such rotation through an inertia brake.

Embodiments of the present invention will now be described by way of example only with reference to the accompanying drawings in which.

Figure 1:
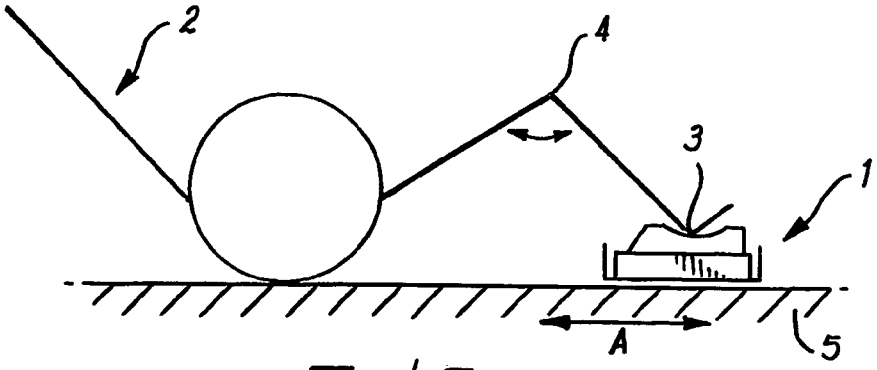
FIG. 1 is a schematic illustration of an exerciser in use in accordance with the present invention.

FIG. 1 is a schematic illustration of an example of use of an exerciser 1 in accordance with the present invention. Thus, a user 2 in this case places their heel 3 upon the exerciser 1 in order to bend and flex their knee 4 by slide motions in the direction of arrow heads A. The exerciser 1 and for that matter the user 2 will generally be lying upon a bed 5. In these circumstances, the user 2 can exercise their knee 4 by using the exerciser 1 without leaving their bed 5.

The user 2 is thus able to improve flexibility with regard to the knee 4 as well as strength progressively in accordance with their own conditions and capabilities.

FIG. 1 illustrates the exerciser 1 in accordance with the present invention for use principally with regard to exercising a knee 4. However, it will be understood that there are a number of situations where gentle oscillatory motion is required in order to progressively improve flexibility and strength within a patient or user. For example, an exerciser is required after heel, hip and shoulder surgery. Patients who have suffered a stroke may gradually improve their nervous reflex response by oscillating an exerciser upon a table with forward and rearward motions and/or side to side motions in order to regain both flexibility and strength as well as confidence in their ability to achieve such movements in a controlled fashion.

Figure 2:
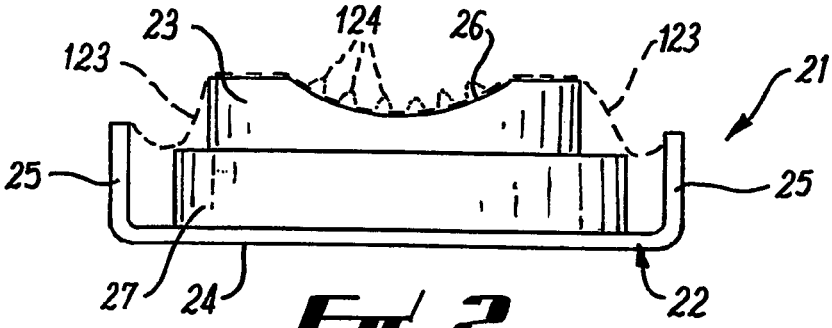
FIG. 2 is a schematic cross-section of a first embodiment of an exerciser in accordance with the present invention.
Figure 3:
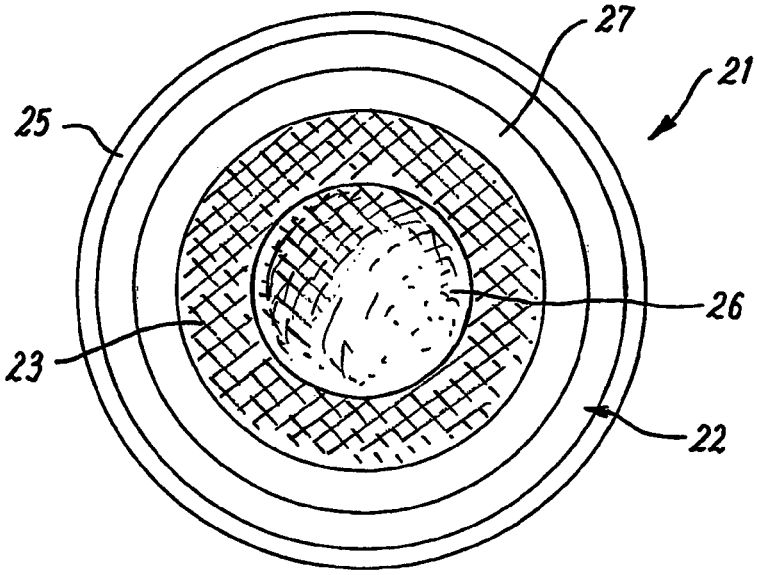
FIG. 3 is a schematic plan view of the exerciser depicted in FIG. 2.

FIGS. 2 and 3 illustrate in more particular detail a first embodiment of an exerciser 21 in accordance with the present invention. Thus, the exerciser 21 essentially comprises a skid 22 upon which a grip 23 may be located or a grip integrally formed with the skid. The skid 22 has a bottom slide surface 24 which is chosen to allow the exerciser 21 to slide upon all expected surfaces for which the exerciser 21 will be used. As indicated previously, the exerciser 21 will normally be used upon a bed surface so that the edges or rim 25 are curved upwardly to prevent snagging with bed sheets etc.

The grip 23 is typically raised above the skid 22 and normally incorporates a depression 26 to accommodate a user's heel or elbow or simply to act as an appropriate rest for a user's limb. The grip 23 may be made from a suitably tactile material to provide grip. Such tactile materials include elastomeric rubbers perhaps presented in a mesh format to provide non-slip properties in engagement with the user's heel, elbow or limb. Generally, the grip 23 will be shaped for the expected limb abutment in order to appropriately engage that limb for grip in the sliding oscillatory motion of the present exerciser 21.

Alternatively, a skid may be provided which is an integral unit with the grip formed with the skid during a moulding or stamping or machining fabrication process. The grip, in such circumstances, will still include a depression but this depression has ribs or a cross-hatched surface to provide a non-slip nature for engagement with the user. Thus, as shown in FIG. 2 by broken line 123 a single moulding could be provided with ribs or hatches 124 (broken line) providing a non-slip surface.

In FIGS. 2 and 3 the exerciser 21 is substantially round and in the shape of a saucer. This shape again resists snagging with bed sheets and mattress surfaces. However, it will be understood that other shapes including oblong, rectangular and polygons could be used provided any corners are appropriately chamfered, smoothed or otherwise shaped to resist snagging.

As illustrated in FIGS. 2 and 3 the grip 23 and where used the non-slip layer 27 may be wholly confined within the hollow created by the skid 22. In such circumstances, the grip 23 may be secured to the skid 22 through an adhesive or other mechanism such as a hook and fleece/Velcro fastening. Alternatively, the grip 23 may be sized such that it is in a compression fit within the hollow of the skid 22.

Hygiene is of particular importance with regard to exercising. Thus, the present exerciser 21 can be designed as a unitary moulding such that all of the components, that is to say skid 22 and grip 23 can be sterilised by appropriate heating to an elevated temperature and/or washing in a sterilising solution. For example, the skid 22 may be made from a heat resistant plastic material such as melamine or a metal. An alternative approach to achieving hygienic use is to provide that the grip 23 and where used the non-slip layer 27 are an insert placed within the hollow of the skid 22 as required. In such circumstances, the grip 23 would be removed after each exercise session and a new grip 23 provided for the next patient or next exercise session. These inserts may be disposable or cleanable/sterilisable themselves.

It will be understood that generally, being of a robust nature the skid 22 can be formed from a range of materials which are more readily sterilisable than the grip 23 and so provision of an insert may avoid unacceptable material compromises in order to enable a unitary moulding to be provided which can be wholly sterilised. It will also be understood that a range of grip 23 inserts for differing patient requirements in terms of heel, elbow or limb size as well as exercise required could be provided whilst using the same skid 22.

Figure 4:
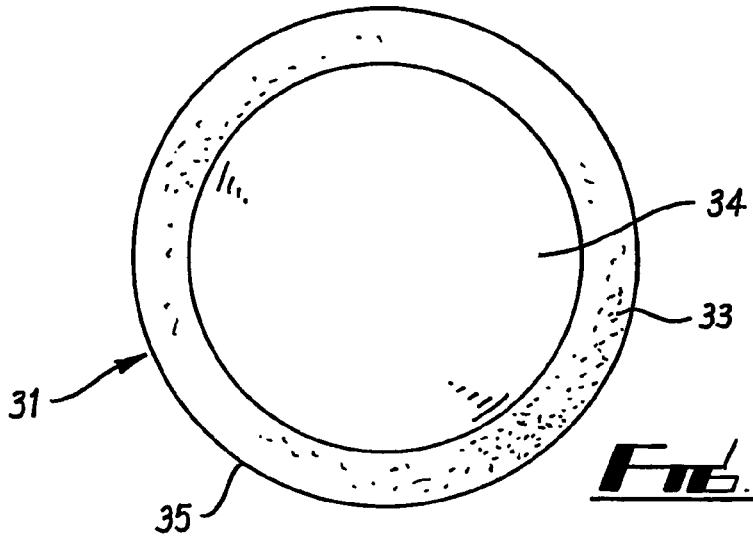
FIG. 4 is a bottom view of a first exerciser refinement.
Figure 5:
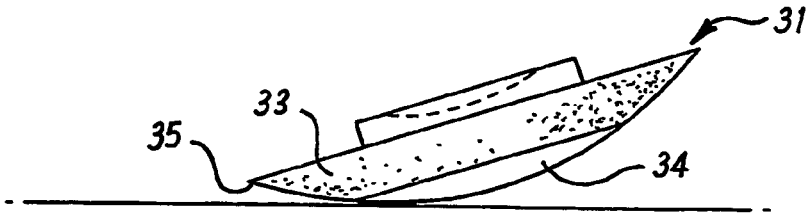
FIG. 5 is a side view of the exerciser depicted in FIG. 4.

Normally, as indicated above, the present exerciser 21 will be used during a rehabilitation phase of physiotherapy and in particular with regard to initial exercising to generate sufficient flexibility and strength prior to more strenuous out of bed exercising. In such circumstances, the slide surface 24 will be generally flat in order to achieve lateral stability for the exerciser 21 in use. However, where an exerciser in accordance with the present invention is used upon a more rigid surface than a bed it is possible if required to provide a slide surface 24 which is shaped to provide some pitch and yore in the oscillatory motion. Clearly, the shaping will generally be by provision of a slight curvature to the sliding surface 24. This curvature may be a simple front to back curve or a side to side curve or a combination in which the slide surface is then substantially domed. This configuration of the slide surface may be of particular benefit with regard to patients with stroke rehabilitation exercising in that progressively more convexed slide surfaces may be provided which will therefore be more liable to topple and therefore providing a challenge to a patient when conducting the oscillatory motions to achieve such motions without toppling either forwards or backwards or side to side. In order to provide an indication of such topple as depicted in FIGS. 4 and 5 the normal slide facility of a slide surface 34 may be inhibited by application of a friction surface 33 adjacent to a rim 35 such that if there is topple that friction surface 33 will engage and so resist further slide motion of an exerciser 31.

Figure 6:
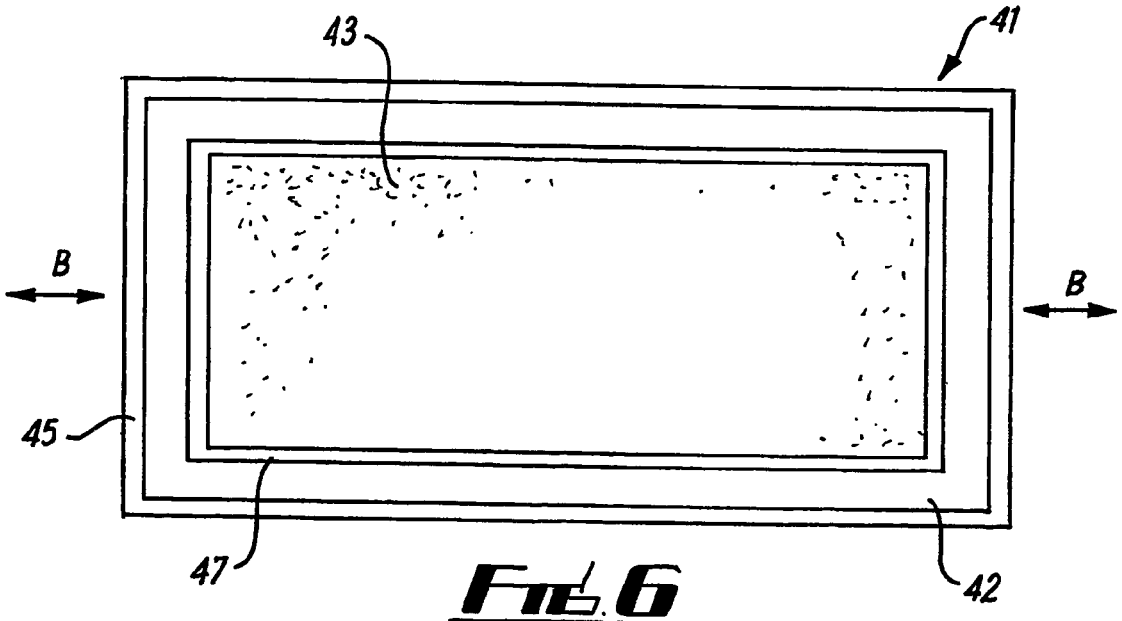
FIG. 6 is a schematic plan view of a second embodiment of an exerciser in accordance with the present invention.

FIG. 6 illustrates as a plan view a second embodiment of an exerciser 41 in accordance with the present invention. Thus, the exerciser 41 again comprises a skid 42 upon which a rim 45 is provided of an upturned curve nature to prevent snagging. A grip 43 is also provided upon a cushioning layer 47. The combination of grip 43 and cushioning layer 47 is secured within a dish or hollow created by the skid 42 within the rim 45. The grip 43 at least is presented above and proud of the rim 45 such that a user's limb, in this case a forearm or hand can be located upon the grip 43 to enable oscillatory motion in a forward and rearward direction, generally indicated by arrow heads B. The exerciser 41 is generally rectangular in shape and is designed for that oscillatory motion in the direction of arrow heads B, but it will be understood if desired there may be slide motion laterally of that direction either pivotally about one end of the exerciser 41 or as a planar motion.

In use, the exerciser 41 will have a user's arm or foot or hand as indicated previously resting and abutting upon the grip 43. In such circumstances, it will be appreciated that, there is a relatively high user skin surface to grip 43 contact area. Specific shaping in the form of dishing to the grip 43 is not required to achieve adequate association between the user and the grip 43 and therefore the exerciser 41 to create the desired oscillatory motion in the direction of arrow heads B. The exerciser 41 will generally be used upon a hard surface such as a floor or table top where simple oscillatory motions in the direction of arrow heads B are required to initiate therapeutic treatment by stimulating some movement in order to gain flexibility, strength and mechanical control of a user's limb.

Figure 7:
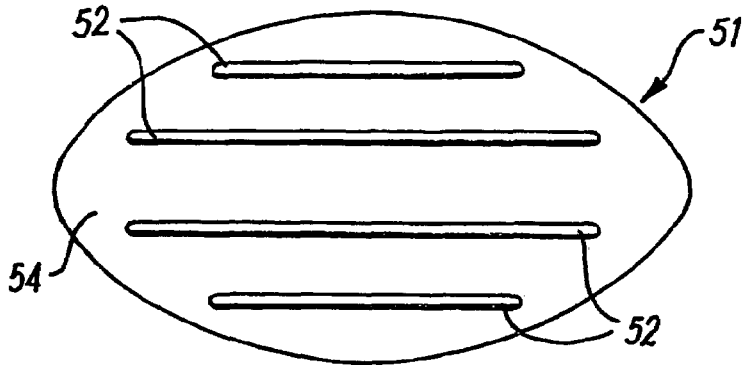
FIG. 7 is a schematic bottom view of a second exerciser refinement.
Figure 8:
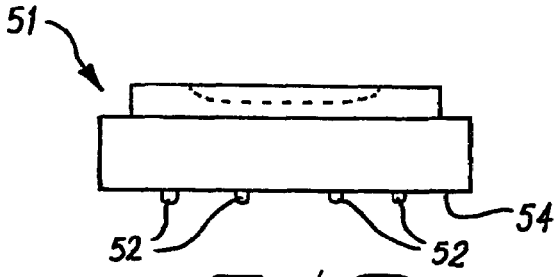
FIG. 8 is a schematic front view of the exerciser depicted in FIG. 5.

Generally, as indicated with regard to the previous Figs. the slide-surface of an exerciser in accordance with the present invention will be flat or at least smoothly curved but this will also render the exerciser equally slideable in all directions. In some circumstances, it may be desirable to provide a preferential slide direction. One means of achieving such preferential slide direction is by providing guide ribs or keels which extend in the desired direction. FIGS. 7 and 8 illustrate such guide ribs or keels 52 upon an exerciser 51. Essentially, the guide ribs 52 present little resistance to oscillatory motion in the direction of arrow heads C whilst resisting lateral or side ways motion to that direction. The use of such guide ribs 52 will be particularly beneficial where a relatively soft surface such as a bed mattress is used as these guide ribs 52 can engage that soft surface in order to provide preferential motion. Achievement of such preferential direction for the oscillatory motion in accordance with the present invention may be particularly beneficial with regard to exercising of joints such as the knee where initially unilateral motion in a straight line is preferred in order not to over strain the newly replaced or treated knee.

Figure 9:
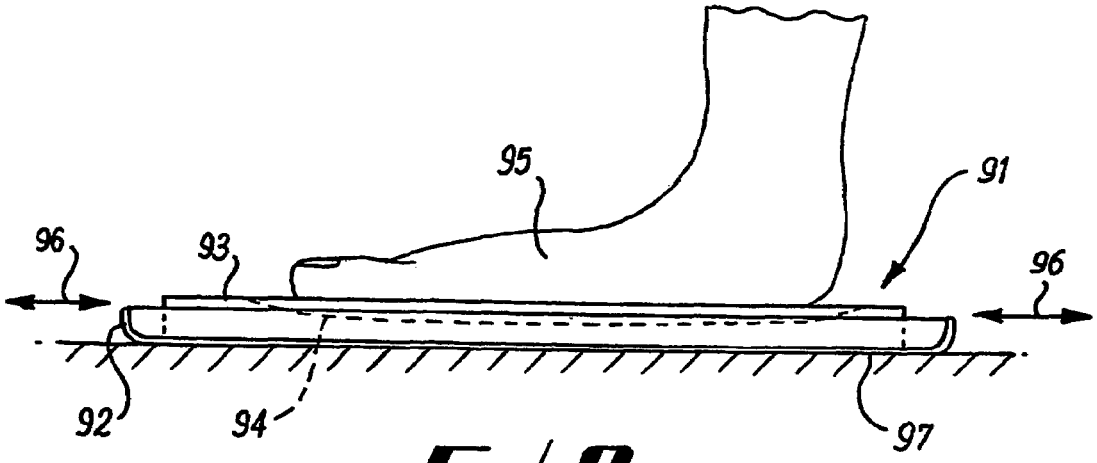
FIG. 9 is a side view of an exerciser in use.

FIG. 9 provides a side view of an exerciser 91 in accordance with the present invention. The exerciser 91 comprises a skid 92 within which a grip 93 is located. The grip 93 incorporates a depression 94 within which a user's foot 95 is located in a non-slip engagement. Thus, the whole exerciser 91 oscillates in the direction of arrow heads 96 in order to provide the desired exercise. The exerciser 91 oscillates in the direction of arrowheads 96 upon a surface 97 which in view of the desired foot exercise will typically be a floor or similar surface 97.

Figure 10:
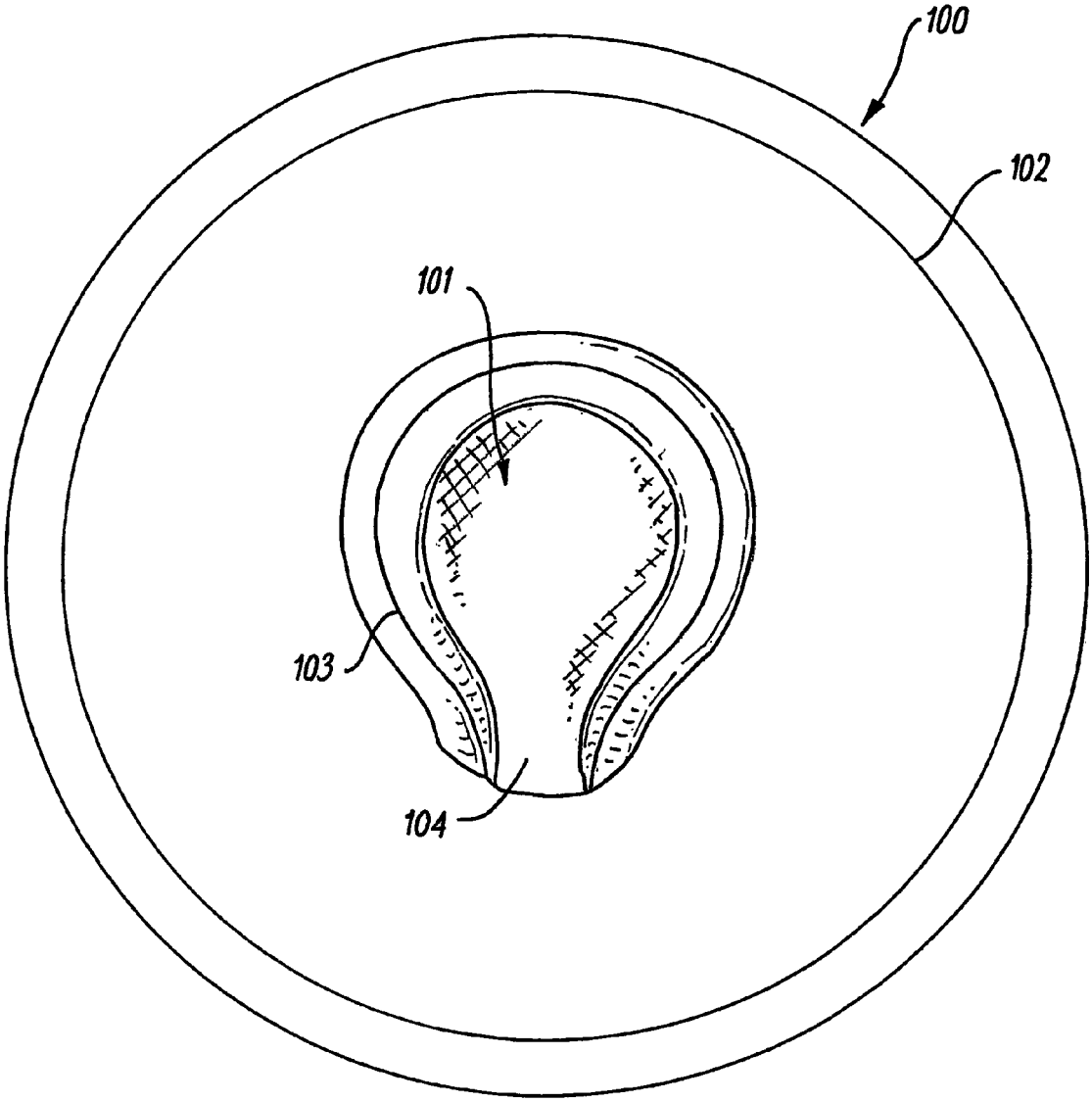
FIG. 10 is a schematic plan view of an exerciser in accordance with the present invention in which the grip is shaped to reciprocally engage a particular limb contour of a potential user.

Referring to FIG. 10 depicting a schematic plan view of an exerciser 100 in which a grip portion 101 is shaped to reciprocate the contours of an expected user's limb. Thus, as previously the exerciser 100 generally incorporates a raised lip 102 about its periphery in order to create a smooth curvature at that periphery to avoid snagging during slide motions. The other side of the exerciser 100 to that of the grip 101 has a slide surface as described previously. In such circumstances the exerciser 100 can slide as required, and if that slide surface includes guide ribs or keels the direction of that slide motion may be controlled.

The grip 101 as indicated is shaped to meet the contours of an expected user's limb. In the particular embodiment depicted in FIG. 10, that contour portion of a user's limb is their ankle. Thus, the grip 101 has a cupped shape to accept a user's heel with a depressed central region surrounded mostly with a raised lip 103 but incorporating an opening 104 within which the user's Achilles tendon is accommodated, whereby a bulb-shaped recess is formed. In such circumstances in use a user's ankle is seated within the grip 100 snugly to allow ready exercising by gentle sliding motions as described above. Clearly, the actual depth of the central region and lip 103 will be dependent upon particular requirements for snug seating. Similarly, a grip used for an elbow may incorporate instead of a deep opening 104 for an Achilles tendon simply less raised sections opposite each other in the raised lip to accommodate a user's forearm and upper arm with the elbow seated snugly in the grip. It will also be understood that the grip will also tend to be formed from pliable material such as a PVC material or a rubber or a foam mesh such that the grip will be deformed into even greater snug fit around the contour of a user's limb or joint as required.

Figure 11:
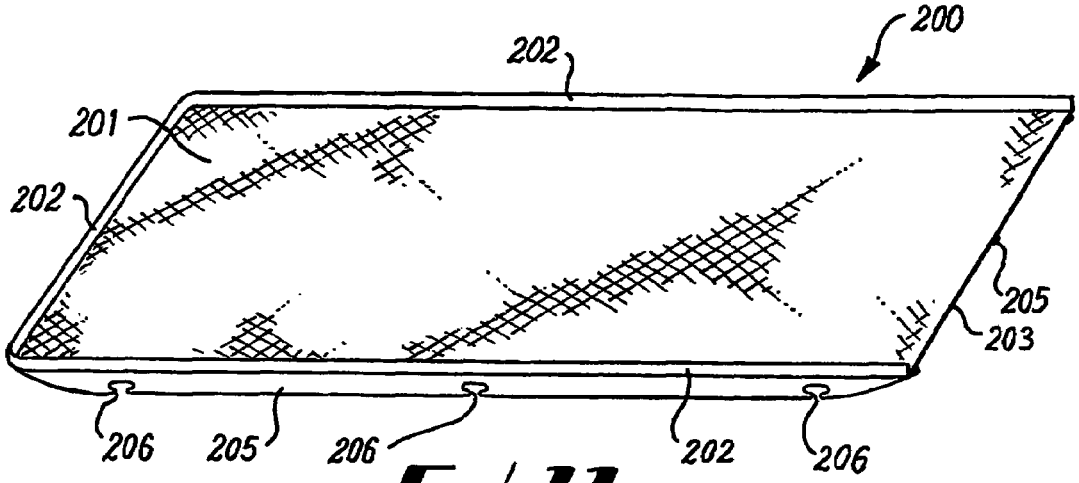
FIG. 11 is a schematic to perspective view of a third embodiment of an exerciser in accordance with the present invention.
Figure 12:
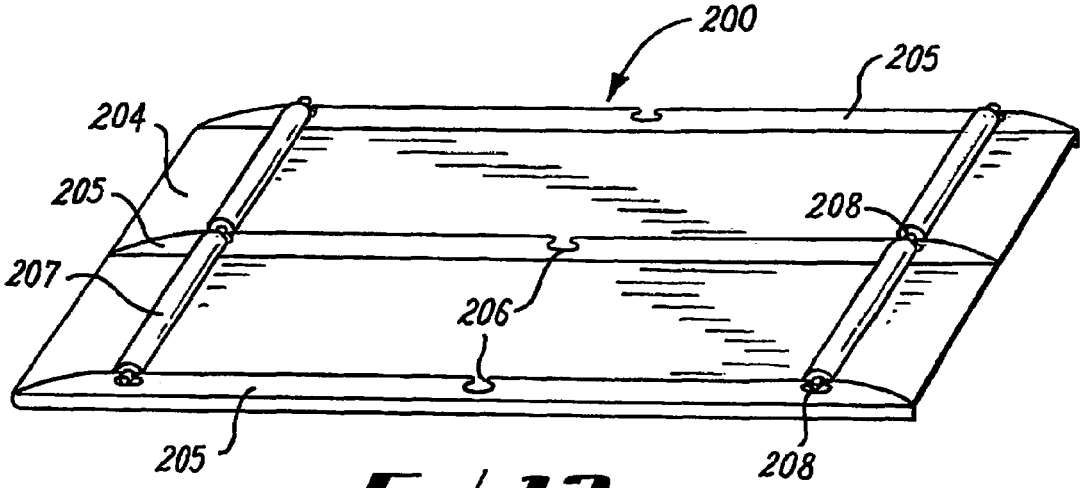
FIG. 12 is a bottom perspective view of the exerciser depicted in FIG. 11 incorporating rollers; and, FIG. 13 is a schematic front view of a roller as depicted in FIG. 12.

Referring to FIGS. 11 and 12 illustrating a third embodiment of an exerciser in accordance with the present invention respectively as a top perspective view and a bottom perspective view. Thus, the exerciser 200 has a generally rectangular shape with a top surface 201 incorporating a raised lip 202 along three sides and an open side 203 at one end to indicate the correct orientation of the exerciser 200. The remainder of the top surface 201 between the lips 202 incorporates a non slip cushion layer to act as a grip for a user's contact with the exerciser 200. In such circumstances a user will place their foot upon the top surface 201 such that it grips with that surface 201. Upon the opposite side to the surface 201 a slide surface 204 is provided. This slide surface 204 incorporates fins or rails 205 in a spaced relationship. These rails 205 generally extend longitudinally along the major axis of the exerciser 200. It will be appreciated that the rails 205 as well as the slide surface 204 between those rails facilitate slide of the exerciser 200 when required. Thus, when the exerciser 200 is being used upon a carpet or mattress the rails 205 along with surface 204 allow ready slide motion of the exerciser 200 guided by the rails 205 as required. However, it will be understood that it is desirable to use the exerciser 200 throughout the rehabilitation process with respect to some recovery procedures. For example, it may be desirable to initiate first exercise with a user in bed such that the exerciser 200 as indicated acts upon a mattress, but further through the recuperation and rehabilitation process the exerciser may then be used in a standing position. Clearly, when in the standing position it is possible that the exerciser may need to be used as indicated upon carpets but also may require usage upon flat hard floors, that is to say tiled or parquet wood surfaces. Thus, the exerciser 200 must be able to operate in a slide fashion upon a range of potential surfaces.

Rails upon some hard surfaces will scratch and mark those surfaces, therefore in accordance with the third embodiment depicted in FIGS. 11 and 12, detent apertures 206 are provided in the fins or rails 205. These detent apertures 206 are arranged to accept, when necessary, rollers 207 such that the peripheral surfaces of those rollers 207 are just proud of the rails or fins 205 to allow slide motion of the exerciser, but still with guidance to a particular slide direction. The detent apertures 206 take the form of bell or bulbous notches in the rails or fins 205 such that bearing parts of the rollers 207 snap fit into these detents 206 for secure location when required, but so that the rollers 207 can be readily removed when necessary. Furthermore, a narrow opening to the apertures 206 reduces the possibility of snagging when the rolls 207 are removed so that the exerciser 200 can be used upon carpeting or a mattress.

As indicated above the rollers 207 are particularly used upon hard floor surfaces and so will generally be removed when the exerciser 200 is used upon softer surfaces such as carpets or a mattress. When the rollers 207 are assembled upon the exerciser 200 it will be appreciated that generally a user will be standing and slide motion will be through pivot arc swing about that user's hip through a foot engagement with the exerciser.

The rollers 207 upon the hard floor surface generally allow slide as indicated but in comparison with situations as described previously upon softer surfaces it will be understood that there is less slide resistance when user effort is removed. In such circumstances, at the fore and aft ends of the exerciser 200 an appropriate safety brake will generally be incorporated. This brake may comprise a portion of the rail or fin 205 arranged to act through friction contact with the surface to brake further slide of the exerciser 200. Operation of the brake may be through the user tipping the fore or aft section as required in order to engage the braking portion of the fin or rail 205 against the surface. Alternatively an inertia brake may be provided within the rollers such that through an appropriate setting or at a predetermined rotational speed the brake is applied. For example, the rollers may be set such that after a certain number of rotations of the rollers the brakes are engaged to prevent further rotation and therefore to stop sliding at the desired slide range displacements. Similarly with a speed inertia brake if the slide motion is too quick and therefore unacceptable for the particular rehabilitation stage of the user then the brake will be applied. In any event, through use of the brake the displacement arc can be predetermined by setting the number of rotations of the roller and also through, judicious choice of the rotational speed inertia brake the rate of such displacement can be limited for particular user's requirements.

Figure 13:
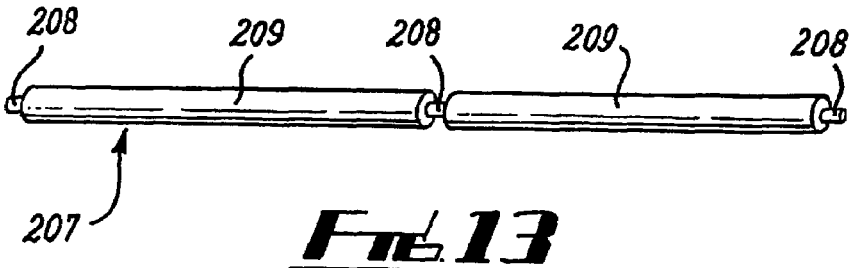

FIG. 13 illustrates a roller 207 as depicted in FIG. 12. As can be seen the roller 207 comprises bearings 208 to engage respective detent notches or apertures in fins or rails as described previously. Between the bearings 208 roller surfaces 209 are provided which in use engage the surface upon which the exerciser slides. These roller surfaces 209 will generally have a relatively high coefficient of friction in order to grip the surface to prevent sideways slide of the exerciser and therefore guide the slide direction as described. The rollers provide slide of the exerciser 200 in the desired direction with rotation about the bearings 208 relatively free whilst sideways or askew rotation is resisted.

As illustrated generally a roller will extend across all rails 205 of an exerciser 200 with respective bearings 208 in detent notches in each rail. Alternatively each detent notch may incorporates its own bogey wheel arrangement (not shown) comprising a central axle with wheel discs at each end. The central axle being forced into engagement with the detent notch in order to present the bogey wheel as a means for precipitating slide upon hard surfaces. However, it will be understood that use of bogey wheels may render provision of an appropriate brake for limiting displacement arc and/or rotational speed more difficult.

As indicated above the present invention particularly relates to exercisers for use with respect to rehabilitation after orthopaedic surgery. However, as also indicated exercisers in accordance with the present invention may be utilised with respect to maintenance of some mobility despite infirmity or to enable muscle stimulation development and maintenance despite forced lack of ambularity.

As indicated previously, an exerciser in accordance with the present invention can be used for a number of user limbs and joints including arms, elbows, and leg movements without necessity of providing a heavy slide board and provision of a specific ring or doughnut bandage for each patient or user. In such circumstances, the present exerciser provides a more convenient means of achieving initial exercise after surgery or in other situations where gradual recovery of mobility is required. Furthermore, due to its ready portability an exerciser can be easily transported to allow convenient spare time or leisure exercise for general fitness.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An exerciser for physiotherapy, the exerciser comprising a skid with a substantially flat slide surface upon one side and a grip for engaging a user's heel on the other side of the skid, the grip being deformable to allow compressive abutment with the user's heel for a non-slip association therebetween in use based upon the heel simply resting upon the grip, the heel and exerciser slidable substantially longitudinally upon a surface for exercise by articulation of the heel about the non-slip association as a point of pivot upon the grip, wherein the skid has an upturned curved rim away from the slide surface to prevent snagging of the exerciser during use, and the grip has a recess shaped for receiving the user's heel in order to facilitate a non-slip association between the grip and the heel, the recess being partially surrounded by a peripheral lip formed with an opening for receiving an Achilles tendon of the user's ankle, whereby the recess is substantially bulb shaped.

2. An exerciser as claimed in claim 1 wherein the skid is a unitary moulding.

3. An exerciser as claimed in claim 1 wherein the skid is stamped or machined to provide an appropriate shape.

4. An exerciser as claimed in claim 1 wherein the skid is formed from a plastics or metal material.

5. An exerciser as claimed in claim 1 wherein the skid is rendered suitable for heat sterilisation.

6. An exerciser as claimed in claim 1 wherein, the skid includes an insert to provide the grip.

7. An exerciser as claimed in claim 6 wherein the insert is disposable.

8. An exerciser as claimed in claim 6 wherein the insert is specifically shaped for a user's requirements.

9. An exerciser as claimed in claim 6 wherein a number of different insert shapes are secured to or moulded into the skid.

10. An exerciser as claimed in claim 1 wherein the skid is dimpled or cross-hatched or has a ribbed surface to provide the grip.

11. An exerciser as claimed in claim 1 wherein the skid is a generally round, oblong, polygon or rectangular shape.

12. An exerciser as claimed in claim 1 wherein the grip is provided by a non-slip elastomeric material.

13. An exerciser as claimed in claim 12 wherein the elastomeric material is a plastic or rubber based material.

14. An exerciser as claimed in claim 1 wherein the upturned rim provides a dished configuration for the skid which cooperates with the grip surface in use.

15. An exerciser as claimed in claim 1 wherein the skid incorporates a cushioning material between the grip and the slide surface.

16. An exerciser as claimed in claim 1 wherein the slide surface includes guide ribs or keels to facilitate a preferred direction of slide for the exerciser.

17. An exerciser for physiotherapy, the exerciser comprising a skid with a substantially flat slide surface at a lower side of the skid, an upturned rim curving away from the slide surface to prevent snagging of the exerciser during use, and a grip for engaging a user's heel at an upper side of the skid, wherein the grip is formed with a recess shaped for receiving the user's heel in order to facilitate a non-slip association between the grip and the heel, the flat slide surface allows the exerciser to slide substantially longitudinally upon a surface when the user's heel engages the grip for exercise by articulation of the heel about the non-slip association with the grip, and the recess is partially surrounded by a peripheral lip formed with an opening for receiving an Achilles tendon of the user's ankle, whereby the recess is substantially bulb shaped.

18. An exerciser according to claim 17, wherein the grip is deformable to allow compressive abutment with the user's heel when the heel rests upon the grip.

19. An exerciser according to claim 18, wherein the grip is detachable from the skid.

* * * * *